United States Patent [19]

Stiller et al.

[11] Patent Number: 5,046,459

[45] Date of Patent: Sep. 10, 1991

[54] OSCILLATORY MOTION APPARATUS

[75] Inventors: Alfred H. Stiller; James E. Smith, both of Morgantown, W. Va.

[73] Assignee: West Virginia University, Morgantown, W. Va.

[21] Appl. No.: 639,362

[22] Filed: Jan. 10, 1991

Related U.S. Application Data

[60] Continuation of Ser. No. 519,259, May 2, 1990, abandoned, which is a continuation of Ser. No. 394,244, Aug. 15, 1989, abandoned, which is a continuation of Ser. No. 265,184, Oct. 31, 1988, abandoned, which is a continuation of Ser. No. 14,420, Feb. 12, 1987, abandoned, which is a division of Ser. No. 832,324, Feb. 24, 1986, Pat. No. 4,682,569, which is a division of Ser. No. 706,153, Feb. 27, 1985, Pat. No. 4,641,611, which is a continuation-in-part of Ser. No. 628,248, Jul. 6, 1984, abandoned.

[51] Int. Cl.[5] ..... F02B 75/22

[52] U.S. Cl. ..... 123/55 R; 123/56 AC; 123/56 BC; 123/197 R

[58] Field of Search ..... 123/55 R, 55 A, 55 AA, 123/56 R, 56 AC, 56 C, 197 R, 197 A, 197 AB, 56 BC

[56] References Cited

U.S. PATENT DOCUMENTS

| | | | |
|---|---|---|---|
| 1,287,797 | 12/1918 | Tietzmann | 123/56 AC |
| 1,298,098 | 3/1919 | Rothchild | 123/55 AA |
| 1,735,764 | 11/1929 | Johnson | 123/55 AA |
| 1,977,075 | 10/1934 | Magnuson | 123/197 R |
| 2,137,730 | 11/1938 | Smith | 123/56 AC |
| 2,421,164 | 5/1947 | Senkowski | 123/55 A |
| 2,790,431 | 4/1957 | Gassmann | 123/90.31 |
| 2,807,249 | 9/1957 | Peras | 123/56 BC |
| 3,277,743 | 10/1966 | Kell | 123/55 A |
| 3,329,134 | 7/1967 | Llewellyn | 123/197 A |
| 3,583,155 | 6/1971 | Schuman | 60/24 |
| 3,786,790 | 1/1974 | Plevyak | 123/58 C |
| 3,831,565 | 8/1974 | Avery | 123/55 A |
| 4,419,971 | 12/1983 | Nakamura et al. | 123/193 C |
| 4,485,768 | 12/1984 | Heniges | 123/48 B |
| 4,641,611 | 2/1987 | Stiller et al. | 123/55 A |

FOREIGN PATENT DOCUMENTS

| | | | |
|---|---|---|---|
| 996687 | 9/1951 | France . | |
| 251265 | 3/1927 | United Kingdom | 123/56 AC |
| 2038984 | 7/1983 | United Kingdom . | |

OTHER PUBLICATIONS

Baker et al.; An Eccentric Crank Mechanism, Instn. Mech. Engrs. Mechanisms; 1/1973; Paper No. 4, pp. 20–29.

*Primary Examiner*—David A. Okonsky

*Attorney, Agent, or Firm*—Arnold B. Silverman

[57] ABSTRACT

Oscillatory motion apparatus has a first reciprocating rod oriented generally perpendicularly with respect to a second reciprocating rod. A first trammel gear is pivotally secured to the first and second rods. Reciprocation of the rods produces responsive rotation of the trammel gear. An output gear may be rotated responsive to rotation of the trammel gear. The invention may be embodied in an engine block and two or more pairs of opposed cylinders each containing pistons adapted for reciprocation therein is provided. The rods, which may be connecting rods, connect pairs of opposed pistons. The connecting rods are preferably oriented generally perpendicularly with respect to each other. The connecting rods are rotatably connected to the trammel gear. Reciprocation of the pistons results in rotation of the trammel gear which is operatively associated with an output gear to produce rotary output. In one embodiment a bifurcated connecting rod permits two trammel gears to be employed with corresponding use of two output gears. In another embodiment, a planetary arrangement is provided. The engine is compact, lightweight and has a very high horsepower to weight ratio.

18 Claims, 8 Drawing Sheets

OSCILLATORY MOTION APPARATUS

CROSS REFERENCE TO RELATED APPLICATION

This application is a continuation of application Ser. No. 07/519,259, abandoned, filed May 2, 1990, which is a continuation of Ser. No. 07/394,244, abandoned, filed Aug. 15, 1989, which is a continuation of Ser. No. 07/265,184, abandoned, filed Oct. 31, 1988, which is a continuation of application Ser. No. 07/014,420, abandoned, filed Feb. 12, 1987, which is a division of Ser. No. 06/832,324, U.S. Pat. No. 4,682,569, filed Feb. 24, 1986, which is a division of Ser. No. 06/706,153, U.S. Pat. No. 4,641,611, filed Feb. 27, 1985, which is a continuation in part of Ser. No. 06/628,248, filed Jul. 6, 1984, now abandoned.

BACKGROUND OF THE INVENTION

1. Field of the Invention

The present invention relates to an oscillatory motion device having pairs of opposed end members connected by rigid connecting rods and employing trammel means.

2. Description of the Prior Art

The advantageous use of engines of various types including four cycle internal combustion engines for automobiles, trucks, boats, airplanes and in various types of equipment has long been known. The use of two-cycle internal combustion engines in lawn mowers, snow blowers, motorcycles and other uses has long been known.

The Scotch Yoke and elliptical trammel are known means of converting oscillatory motion of a first member into responsive oscillatory motion of a second member.

U.S. Pat. No. 3,583,155 discloses an engine having a free piston cooperating with a driven piston through an elongated gas passageway.

U.S. Pat. No. 3,786,790 discloses an internal combustion engine having a pair of pistons connected for common synchronized reciprocating motion.

U.S. Pat. No. 2,807,249 discloses a two stroke, two cylinder, linear opposed engine which employs a standard type of crank, and belt transmission means.

U.S. Pat. No. 1,287,797 discloses an internal combustion engine having pairs of opposed pistons.

French Patent 996,687 discloses an opposed piston internal combustion engine which employs a counterweighted planetary gear mechanism and non-articulating connecting rods.

U.S. Pat. No. 4,485,768 discloses an engine which employs a Scotch yoke and has means for altering the orbit of a slider to change the piston stroke and compression ratio of the engine.

U.S. Pat. No. 2,137,730 discloses opposed piston engines employing a crank disk.

In spite of the numerous varieties of motion converting apparatus and engines in current use and the additional disclosures of other types of motion converting devices, there remains a need for improved oscillatory motion apparatus.

BRIEF DESCRIPTION OF THE INVENTION

The present invention has met the above-described need. The oscillatory motion apparatus has a first reciprocating rod preferably oriented generally perpendicularly with respect to a second rod. A first trammel gear is pivotally secured to the first and second rods. Reciprocation of the rods produces responsive rotation and translation of the trammel gear. An output gear may be rotated responsive to rotation and translation of the trammel gear.

In use in an engine, two pairs of generally opposed cylinders are provided with pistons which reciprocate therein. Each pair of pistons is connected by ar least one non-articulating rigid connecting rod which is preferably oriented generally perpendicularly with respect to the rigid connecting rod connecting the other pair of pistons. Trammel means, which preferably take the form of elliptical trammel means, preferably have connections through the center lines of each connecting rod. This results in reciprocation of the pistons establishing translational and counterrotational motion of the trammel linkage. Output means are operatively associated with the trammel linkage and adapted to provide rotary output responsive to rotation and translation of the trammel linkage.

In the engine embodiment, the cyclic sidewall forces produced by the combustion processes in standard engines by a rotating crank mechanism are in the present invention reacted by engine block mounted bearings which reduce cylinder and ring wear.

In one embodiment, a pair of rigid connecting rods connects a pair of pistons with each connecting rod having a separate trammel connected to it and connected to the other connecting rod which is secured to the other pair of pistons. This permits takeoff through two or more separate output members.

It is an object of the present invention to provide improved oscillatory motion apparatus which is capable of motion conversion to provide usable output.

It is another object of the present invention to provide an engine employing such oscillatory motion apparatus.

It is an object of the present invention to provide an improved, lightweight, dependable internal combustion engine.

It is another object of the present invention to provide such an internal combustion engine which has reduced wear of contact surfaces and improved durability.

It is another object of the present invention to provide moving parts for the engine so positioned as to effect cancellation of forces to minimize vibrations and also permitting use of a lighter engine block and crankcase.

It is another object of the present invention to provide such an internal combustion engine which has a minimum number of moving parts, improved efficiency, a high horsepower to weight ratio and one which may have a generally flat profile which permits use in a smaller engine compartment.

These and other objects of the invention will be more fully understood from the following description of the invention and reference to the illustrations appended hereto.

DESCRIPTION OF THE PREFERRED EMBODIMENTS

While it will be appreciated that the present invention may be employed advantageously in many types of apparatus wherein two members crossing each other have coordinated oscillatory motion, the invention will be described herein with reference to one of the presently preferred uses, i.e., in connection with engines. While the engine may be of any desired type such as for example, steam, pneumatic or hydraulic engines, an internal combustion engine will be described. In connection with embodiments of the invention other than engines, it will be appreciated that elements other than pistons may be secured to the rods. As such elements will not alter the mechanical action of the invention, they will be referred to herein generically as "pistons" even though they may not function as such in a technical sense.

The present invention contemplates a first member being rotated by the oscillating linkage members as will be described hereinafter and a second output member being rotated responsive to rotation of the first member. The first and second members may be of any form suitable for effecting suitable transmission of the rotational movement. The members may be gears which are directly intermeshed directly or indirectly or connected by toothed belts, for example. They may be pulleys or sprockets connected by a suitable belt or chain or any other suitable means. For convenience of reference herein all such members will be referred to generically as "gears" regardless of whether the members have teeth and regardless of whether they are shaped like gears. It will be appreciated that the gears function both as a linkage to connect the connecting rods and as rotary output source.

Figure 1:
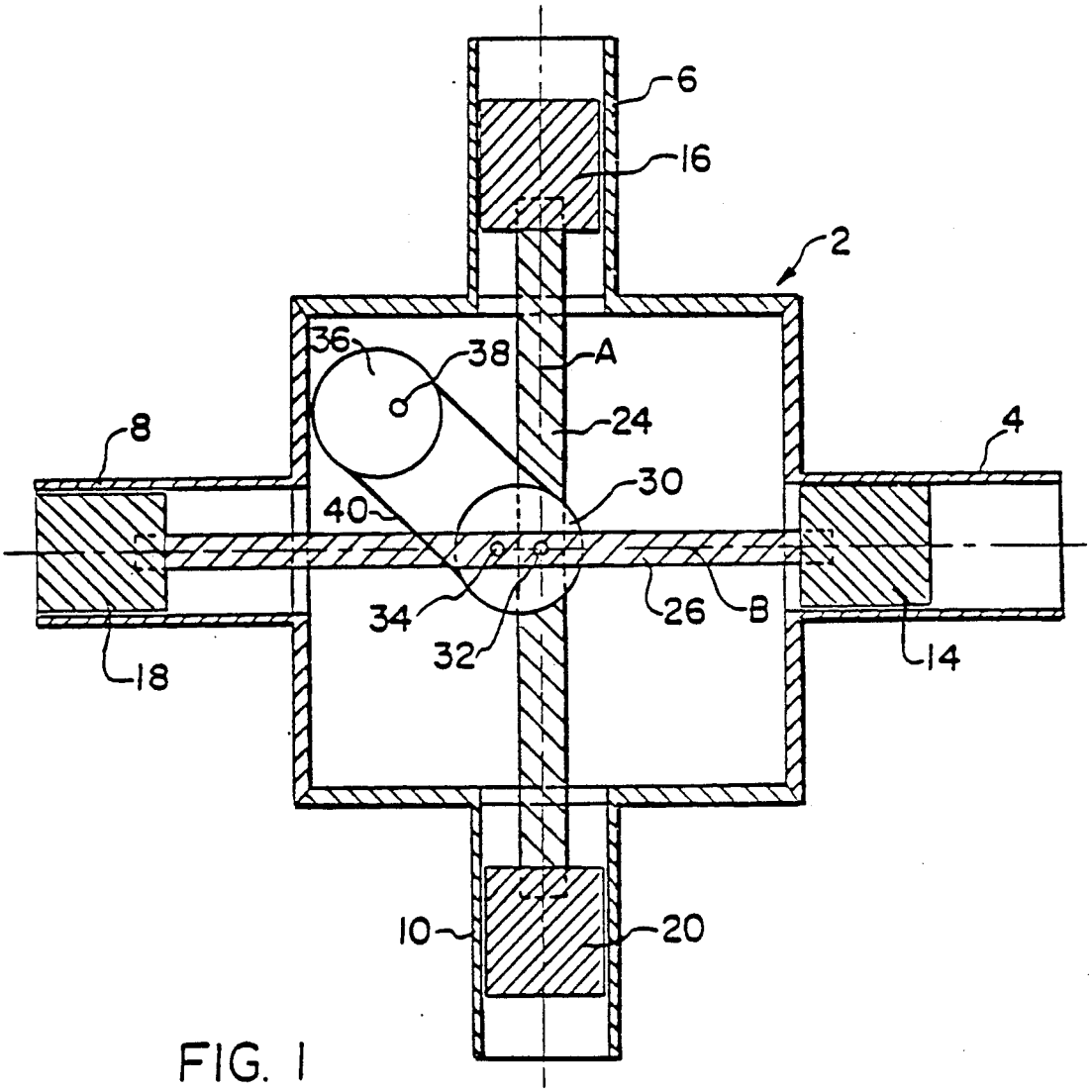
FIG. 1 is a schematic cross-sectional illustration of a form of apparatus of the present invention.

Referring to FIG. 1, there is shown an internal combustion engine having an engine block/crankcase 2 which in the form illustrated is substantially rectangular while a square engine block/crankcase 2 is preferred any shape which permits crossing of the connecting rods and the desired freedom of movement may be employed. A pair of generally rectangular side plates (not shown) may be secured to the rectangular frame to provide for a closed block of generally rectangular configuration. Other configurations may be employed depending upon accessories and complimentary components which might be used with the engine for a particular installation.

Four cylinders 4, 6, 8, 10 project outwardly from the engine block/crankcase 2 and contain, respectively, reciprocating pistons 14, 16, 18, 20. It will be appreciated that pistons 16, 20 are generally aligned and are connected to each other by substantially rigid connecting rod 24 which has a central axis A. Similarly, pistons 14, 18 are generally aligned and are connected by a substantially rigid piston rod 26 which has a central axis B. It will be appreciated that axis A is substantially perpendicular to axis B. Trammel gear 30 is pivotally connected to connecting rod 24 through pivot pin 32 which preferably is disposed on or closely adjacent to central axis A. (For convenience of illustration, the gear teeth will not be shown herein.) Trammel gear 30 is connected to connecting rod 26 through pivot pin 34 and is preferably disposed on axis B. It is preferred that the pin spacing between pins 32, 34 (measured from center to center) be about one-half the length of the piston stroke.

As the engine of the present invention is adapted to function in a two cycle or four cycle engine using a wide variety of fuels, details regarding fuel choice and introduction, combustion and where appropriate valve arrangements and sequence of operations will be readily apparent to those skilled in the art, a detailed disclosure of the same will not be provided herein. It will be appreciated that as the combustible fuel mixture is ignited in each cylinder, that cylinder's piston will be caused to move toward the trammel gear 30. By movement of the various pistons in a predetermined sequence (clockwise or counterclockwise) trammel gear 30 will be caused to rotate and thereby convert the translational movement of connecting rods 24, 26 into responsive rotary and translatory movement of the trammel gear 30.

In a preferred embodiment of the invention, a rotably mounted output gear 36 (shown without teeth) has an output shaft 38 which is eccentrically positioned thereon and supported for axial rotation by suitable bearings (not shown). Output gear 36 is connected to the trammel gear 30 by a toothed endless belt 40. In the form shown, output shaft 38 is generally parallel to and axially offset from trammel pivot pins 32, 34. As a result of the positioning and configuration of the trammel gear 30 and output gear 36, the output shaft 38 will be subjected to rotational movement about its axis responsive to rotation of the trammel gear 30. Output shaft 38, is eccentrically mounted on gear 36 to compound the motion of the trammel gear. In one embodiment of the invention, the periphery of the trammel gear 36 and output gear 36 will have gear teeth and the belt 40 will be an endless toothed belt 40. In another embodiment of the invention, the periphery of the trammel gear 30 and output gear 36 may be grooved to create a pulley effect which cooperates with an endless belt. Other transmission means such as chains operatively associated with a sprocket type trammel gear may be employed.

Figure 2:
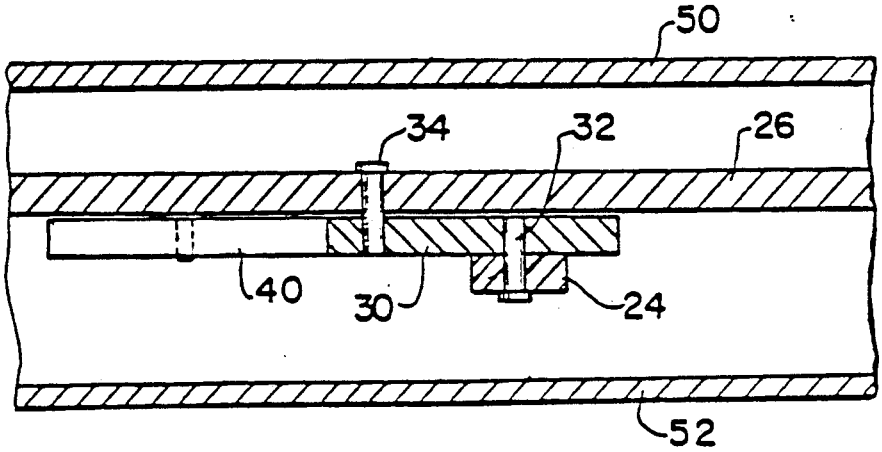
FIG. 2 is a cross-sectional illustration showing a portion of the apparatus of FIG. 1.

Referring to FIG. 2, there is shown a cross-sectional view providing details of the assembly. The side plates 50, 52 are walls of the engine block/crankcase 2. Trammel gear 30 which is generally disk-shaped, is connected to connecting rod 26 by pivot pin 34. The trammel gear 30 is also connected to connecting rod 24 by mean of pivot pin 32. The pivot pins 32, 34 as well as the preferred placement thereof on or closely adjacent to the longitudinal axis A, B, cooperate to convert the reciprocating translational movement of connecting rods 24, 26 into rotary movement of the trammel gear 30.

Figure 3:
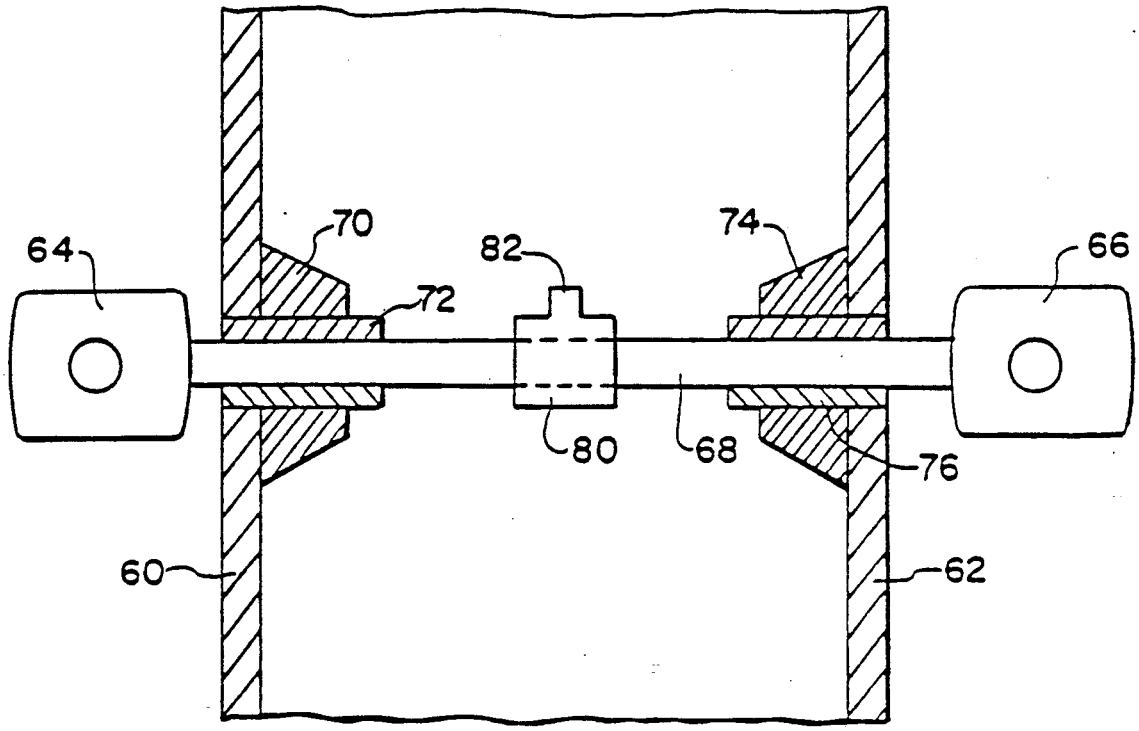
FIG. 3 is a cross-sectional illustration showing a portion of the apparatus of the present invention.

FIG. 3 shows further details of the manner in which the connecting rod may be assembled to cooperate with the opposed pistons. In this embodiment, the engine block has walls 60, 62. Pistons 64, 66 are secured to opposed ends of substantially rigid connecting rod 68. A pillow block 70 supports a linear bearing 72 which passes through engine block/crankcase wall 60. Similarly, pillow block 74 supports linear bearing 76 which passes through engine block wall 62. The linear bearing facilitates reciprocation of the connecting rod 68 responsive to movement of pistons 64, 66 thereby minimizing wear, within the cylinder.

A bearing pin 80 has a projection 82 which is adapted to be received within an opening in the trammel gear (not shown). The bearing pin 80 may be fixedly secured to the connecting rod 68 by means of a suitable mechanical fastener such as a split ring clamp, for example.

Figure 4:
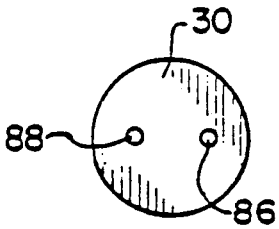
FIG. 4 is a top plan view of a trammel gear of the present invention.
Figure 5:
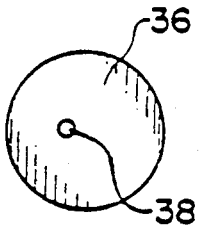
FIG. 5 is a top plan view of a form of output gear member of the present invention.

As is shown in FIG. 4, the trammel gear (shown without teeth) in the form shown has a generally circular configuration. In the form shown, it has a pair of relatively spaced openings 86, 88 which are adapted to receive the pivot pins. If desired, neither of the openings 86, 88 need pass through the center of trammel gear 30. For example, they might be positioned equidistant from the center on opposite sides thereof. If desired, the trammel gear may have a non-circular configuration. FIG. 5 shows generally the circular output gear 36 which has a projecting shaft 38. If desired, gear 36 may have a non-circular configuration.

Figure 6:
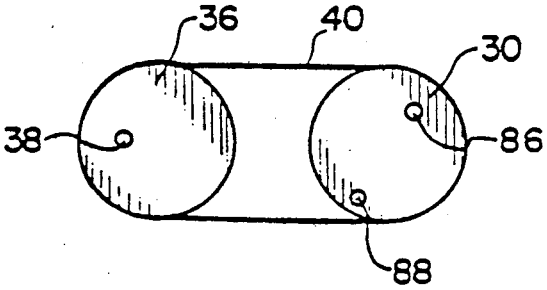
FIG. 6 is a top plan view of a form of trammel gear and output gear member subassembly of the present invention.

As is shown in FIG. 6, the trammel gear 30 and output gear 36 are connected by toothed endless belt 40 such that rotational movement of the trammel gear 30 responsive to reciprocation of the pistons will effect responsive rotation of the output gear 36.

It will be appreciated that the oscillatory motion apparatus of the present invention provides numerous benefits not obtained with prior art constructions. First of all, it has very few moving parts and thus will be economical to manufacture and maintain and will be durable. Further contributing to durability in use in engines is the fact that unlike conventional internal combustion engines wherein the crank-connecting rod assembly driving the pistons are articulating thereby providing uneven cyclic forces to the cylinder walls and piston, the present invention involves pure reciprocation which does not present such uneven unloading. The engine will have a high horsepower to weight ratio, preferably in excess of 1. The engine may be made with a very low profile and may be employed in two cycle as well as four cycle environments. Also, vibrating will be reduced as a result of the offsetting forces of the moving parts cancelling each other.

Figure 7:
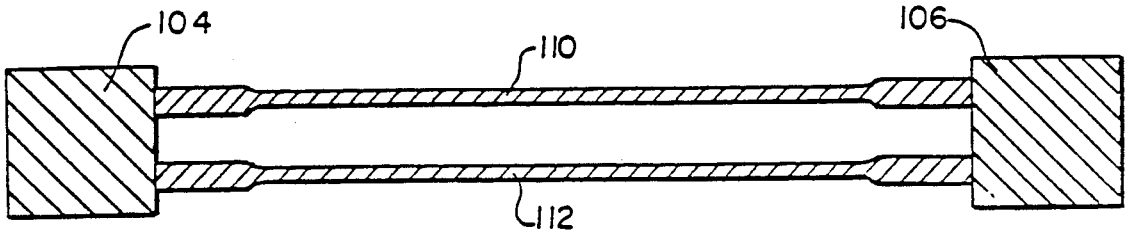
FIG. 7 is a cross-sectional illustration of a modified form of connecting rod of the present invention.
Figure 8:
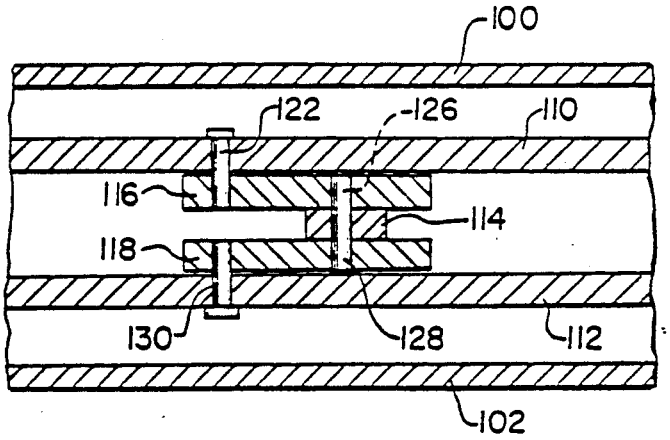
FIG. 8 is a cross-sectional illustration of a modified form of connecting linkage of the present invention.

Referring to FIGS. 7 and 8, a further embodiment of the invention will be considered. Whereas in the embodiment described hereinbefore a rigid unitary connecting rod connected each pair of pistons, in the embodiment of FIGS. 7 and 8 a modification is provided. The engine block walls 100, 102 are spaced from the pair of rigid connecting rods 110, 112 which connect pistons 104, 106. It is preferable that the central portions of the connecting rods be substantially flat, as is true with the first embodiment, in order to facilitate efficient relative movement of the parts. A single rigid connecting bar 114 is oriented generally perpendicularly to connecting rods 110, 112 and connects a pair of pistons (not shown). A pair of trammel gears 116, 118 is provided. Trammel gear 116 is pivotally connected to the axis of connecting rod 114 by pin 126 (shown as being behind pin 128 in this view). This portion of the assembly will function exactly as in the hereinbefore described embodiment. In addition, second trammel gear 118 is pivotally connected to the axis of connecting rod 114 by pin 128 which enters connecting rod 114 at a position spaced from pin 126. In this fashion as pistons 104, 106 are subjected to reciprocating movement, both trammel gears 116, 118 will be caused to rotate and translate responsively thereto. Output gears such as 36 (FIG. 1) may be provided independently for each of the trammel gears 116, 118 and preferably are spaced from the trammel gears in opposite directions with respect to each other. As a result, independent rotary output is provided for each of the two trammel gears 116, 118. If desired, a flywheel (not shown) may be secured to the output shafts in order to enhance efficiency of operation of the engine. The trammel gear and output gear generally will have sufficient weight to make a flywheel unnecessary.

Figure 9:
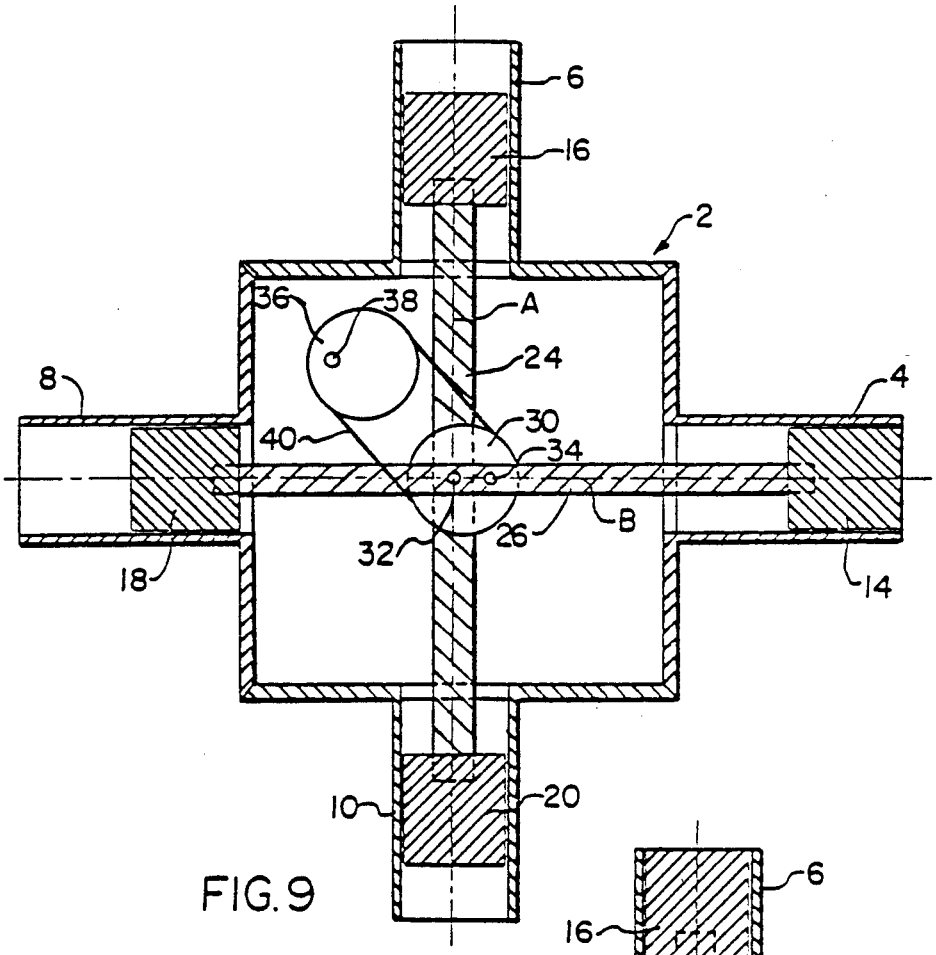
FIG. 9 is a schematic cross-sectional illustration of the apparatus of FIG. 1 with the pistons in a different position.
Figure 10:
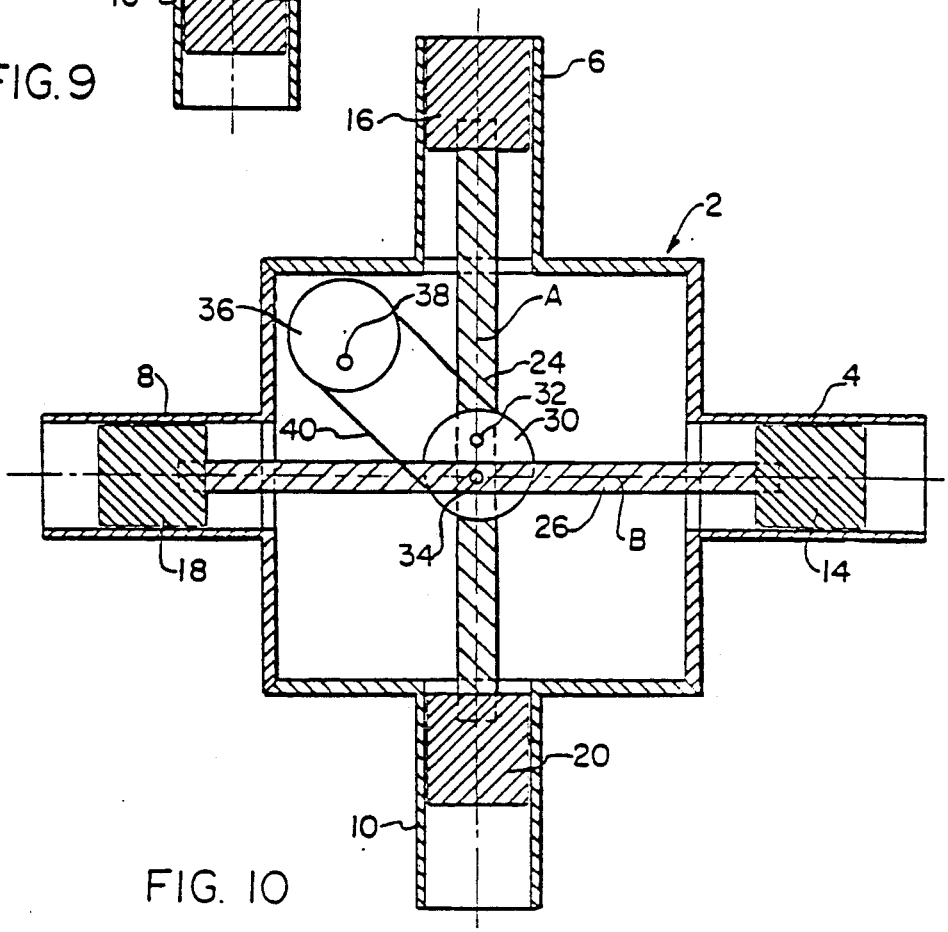
FIG. 10 is a schematic cross-sectional illustration of the apparatus of FIGS. 1 and 9 with the pistons in a different position.

Referring to FIGS. 9 and 10, the apparatus of FIG. 1 is illustrated, but with the pistons in different positions. In FIG. 1, piston 18 is shown in its outermost position, piston 14 in innermost position and pistons 16, 20 are in intermediate positions. Piston 18 in FIG. 1 is in the firing stage, piston 20 is in the compression stage and piston 16 is in the exhausting stage.

Figure 11:
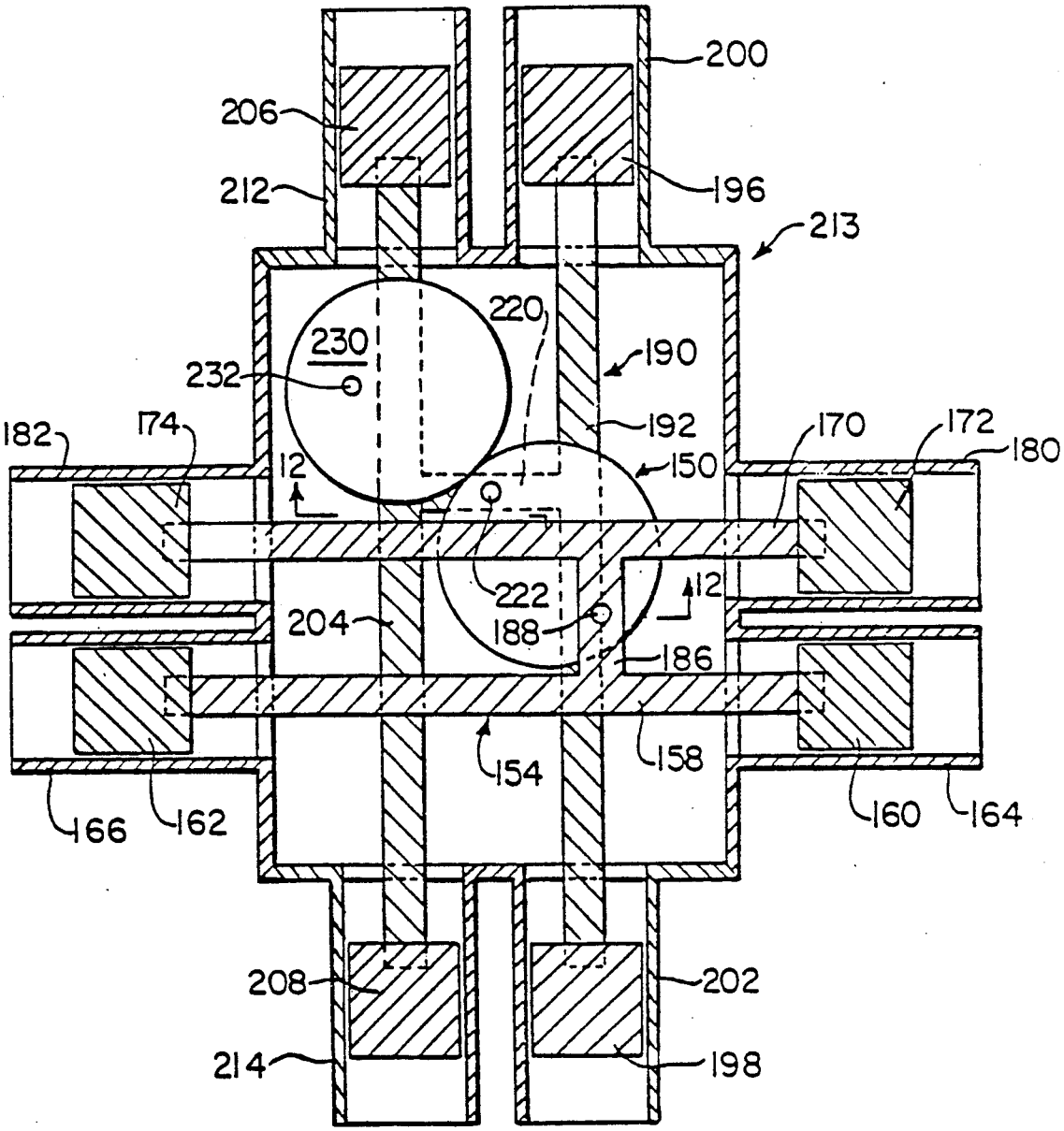
FIG. 11 is a schematic cross-sectional illustration of a modified form of the invention.
Figure 12:
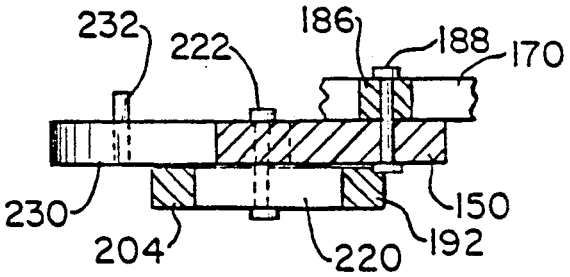
FIG. 12 is a cross-sectional illustration of the embodiment of FIG. 11 taken through 12—12.

FIGS. 11 and 12, show a modified form of the invention employing a single trammel gear 150 in an eight cylinder engine. A first generally H-shaped rigid connecting rod means 154 has a first rod 158 secured to pistons 160, 162 which are positioned respectively, within cylinders 180, 182, and cross-member 186 creates a rigid connection between first rod 158 and second rod 170. Pin means 188 pivotally connects trammel gear 150 with generally H-shaped connecting rod 154.

A second generally H-shaped rigid connecting rod means 190 is oriented generally perpendicularly with respect to first connecting rod 154. Second connecting rod means 190 has third connecting rod 192 to which are attached pistons 196, 198 which are received within cylinders 200, 202, respectively. Second connecting rod means 190 has fourth connecting rod 204 with pistons 206, 208 secured thereto and disposed in cylinders 212, 214, respectively. Cross-member 220 connects third connecting rod 192 to fourth connecting rod 204. Pin means 222 connects cross-member 220 to trammel gear 150.

As in the other embodiments, oscillating movement of first connecting rod means 154 and second connecting rod means 190 will effect rotation of trammel gear 150. Trammel gear 150 which has teeth (not shown) meshed with teeth (not shown) on output gear 230 which is fixedly secured to eccentrically positioned output shaft 232. As a result, rotary output results from oscillation of the connecting rod means.

While the engine block 213 has been shown in FIG. 11 as being generally rectangular it is generally preferable to employ a square block. Any shape which will permit the desired freedom of movement of engine parts may be employed.

In the position shown in FIG. 11, all of the pistons are disposed generally in the midpoint of their path of travel. If the engine is a four cycle engine, one piston of a pair would be firing while the other would be exhausting. The sequence of cycles may be any desired such as in the clockwise or counterclockwise directions.

The use of the present invention in an engine provides an environment of constrained linear motion which resists piston slap and excessive cylinder wall shock forces. The forces of combustion and inertia and absorbed and reacted by the linear sidewall bearings which isolate the piston and cylinder walls from the destruction forces generally associated with reciprocating engines. As a result, the combustion chamber components need only resist compressive forces and not tension, compression and bending. Reduction of non-compressive forces allows use of ceramic materials which have limited ability to handle such non-compressive forces, but can handle higher temperatures and have better wear characteristics than other materials such as steel or aluminum.

The piston and connecting rod motion of the present invention employ linear oscillatory motion essentially within a plane. This is to be contrasted with conventional engines which have crank-connecting rod assemblies providing uneven cyclic forces to the cylinder walls and piston. The present invention permits the advantageous use of ceramic materials. Ceramic materials generally cannot be employed efficiently in conventional engines as they have inadequate strength and wearing properties. The present invention permits advantageous use of cylinders which are made of ceramics or have ceramic linings which may take the form, for example, of a ceramic sleeve or coating. This lining may be employed in combination with a steel cylinder. Such use of ceramics would tend to reduce engine vibrations, reduce wear, reduce undesired loss of ring pressure and permit the engine to operate at higher temperatures to reduce undesired oxide emissions. The pistons, heads and valves may also be made of ceramics.

A wide variety of ceramic materials may be employed successfully in the present invention. Among the specific materials presently believed to be suitable are materials selected from the group consisting of silicon nitride and silicon carbide. Another suitable material is that sold under the trade designation Syalon.

The pistons shown in FIG. 1 will generally, depending upon output requirements, be fired in a clockwise sequence (14, 20, 18, 16) or a counter-clockwise sequence (14, 16, 18, 20).

In FIG. 9, for this two cycle configuration piston 14 is in the firing stage, piston 16 is in the compression stage and piston 20 is in the exhausting stage. Similarly, in FIG. 10, piston 16 is in the firing stage, piston 18 is in the compressing stage and piston 14 is in the exhausting stage.

Figure 13:
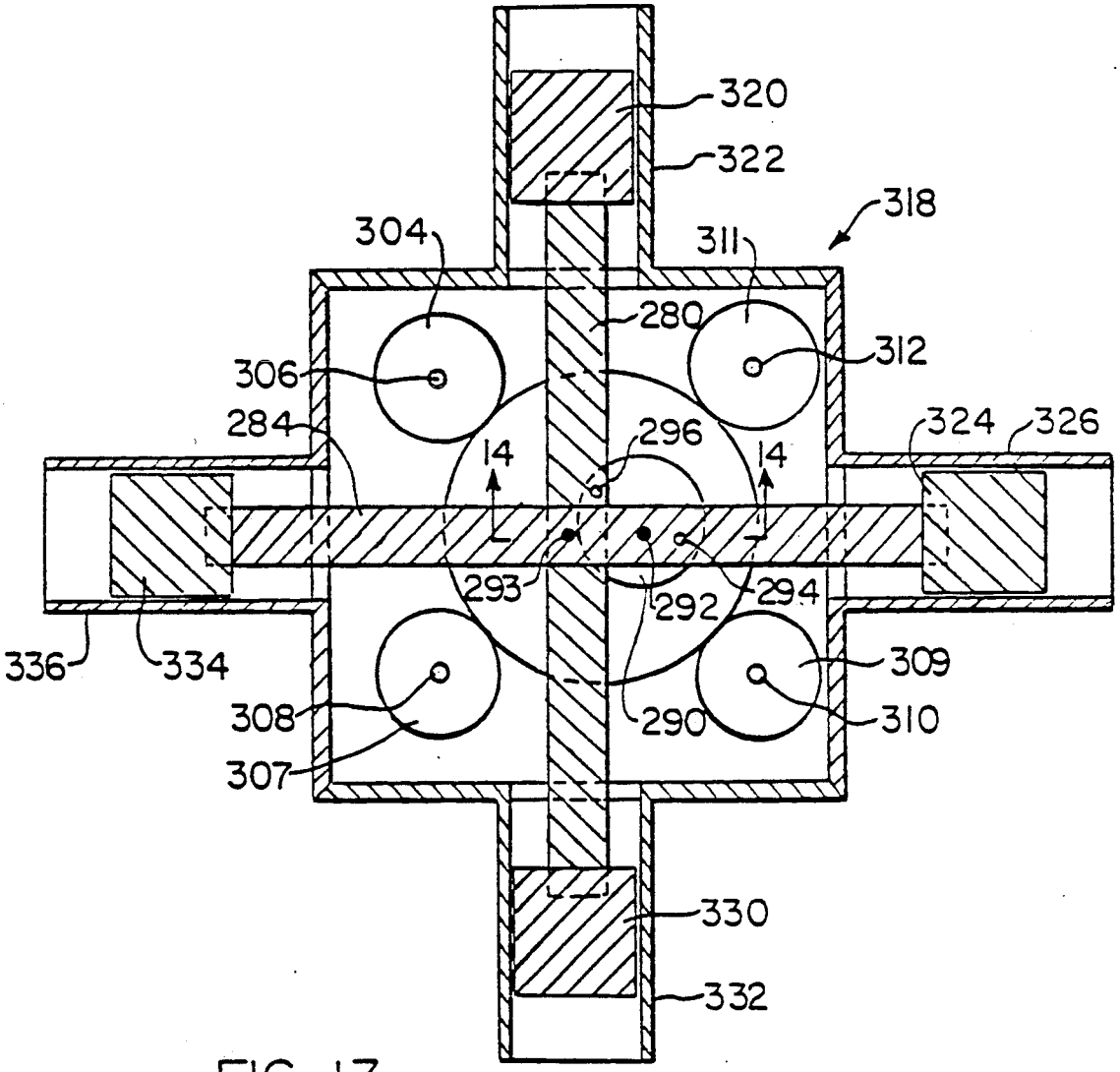
FIG. 13 is a schematic view of another embodiment of the invention.
Figure 14:
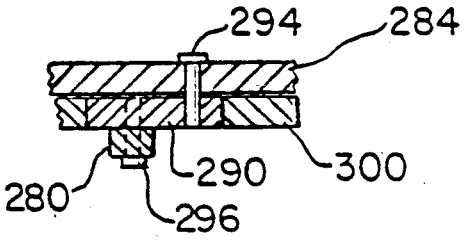
FIG. 14 is a cross-sectional illustration of the assembly of FIG. 13 taken through 14—14.

Referring to FIGS. 13 and 14 there is shown a modified form of the invention. In this embodiment a first rigid connecting rod 280 is disposed within an engine block 318 and has a pair of pistons 320, 330 secured to opposed ends thereof which pistons oscillate within cylinders 322, 332 respectively. Second rigid connecting rod 284 has pistons 324, 334 secured thereto. Pistons 324, 334 oscillate respectively within cylinders 326, 336. Trammel gear 290 is pivotally secured to connecting rod 280 by pin means 296 and to connecting rod 284 by pin means 294. Oscillation of connecting rods 280, 284 will effect rotation of trammel gear 290 which has its center 292 spaced from the point 293 of axial intersection of connecting rods 280, 284. Trammel gear 290 preferably has a journaled bearing surface (not shown) which contacts the inner surface of ring gear 300 which has an opening which receives trammel gear 290. External gear teeth on ring gear 300 will mesh with external gear teeth on output gears, 304, 307, 309, 311 which fixedly area respectively secured to centrally positioned output shafts 306, 308, 310, 312. In this manner, rotation of trammel gear 290 effects responsive rotation of output shafts 306, 308, 310, 312 through gears 300, 304, 307, 309, 311.

It will be appreciated that while four output gears 304, 307, 309, 311 have been shown associated with said ring gear 300 in planetary fashion other numbers of such output gears may be employed if desired.

Figure 15:
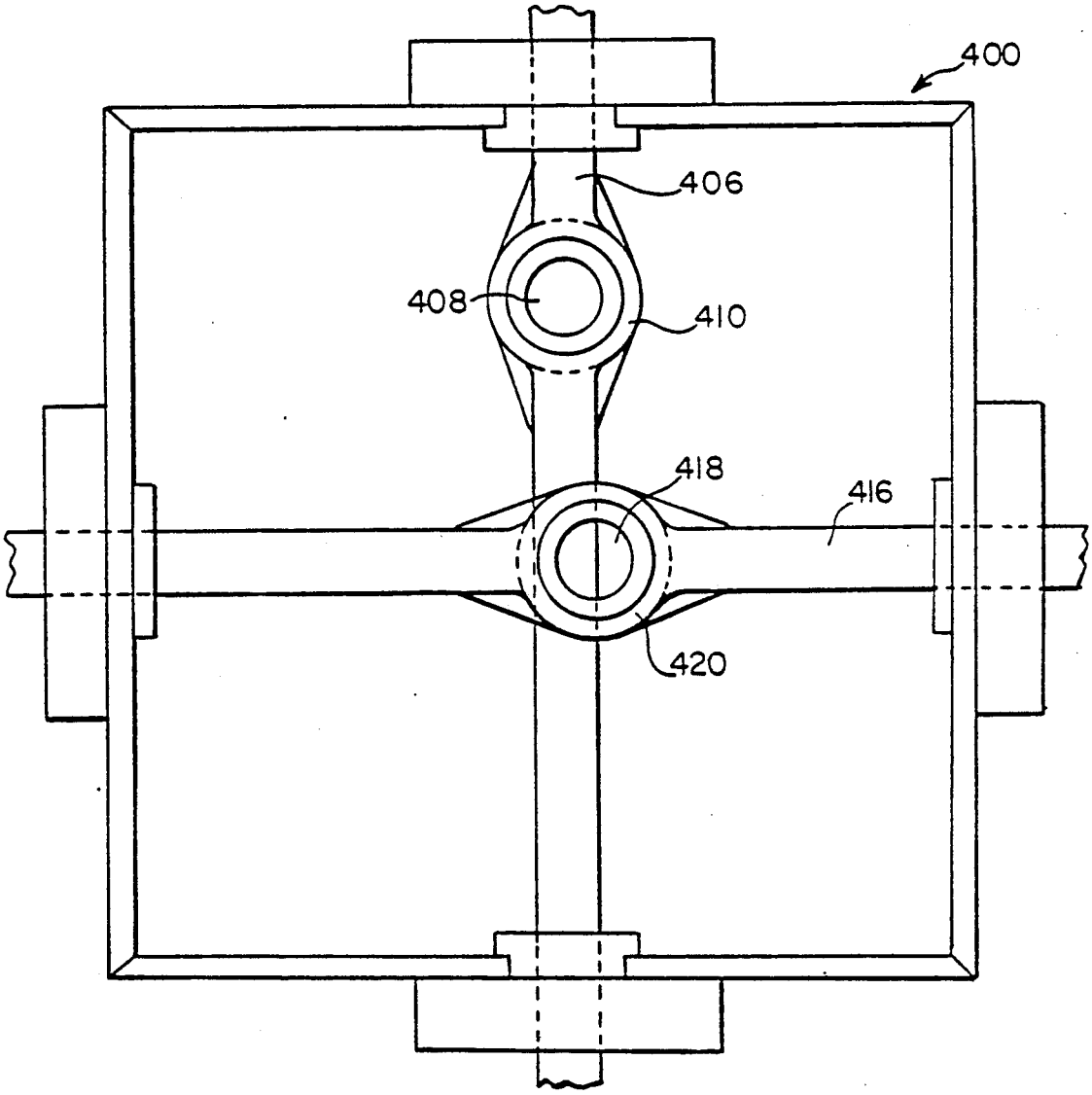
FIG. 15 is a schematic cross-sectional illustration of a further embodiment of the inventions.
Figure 16:
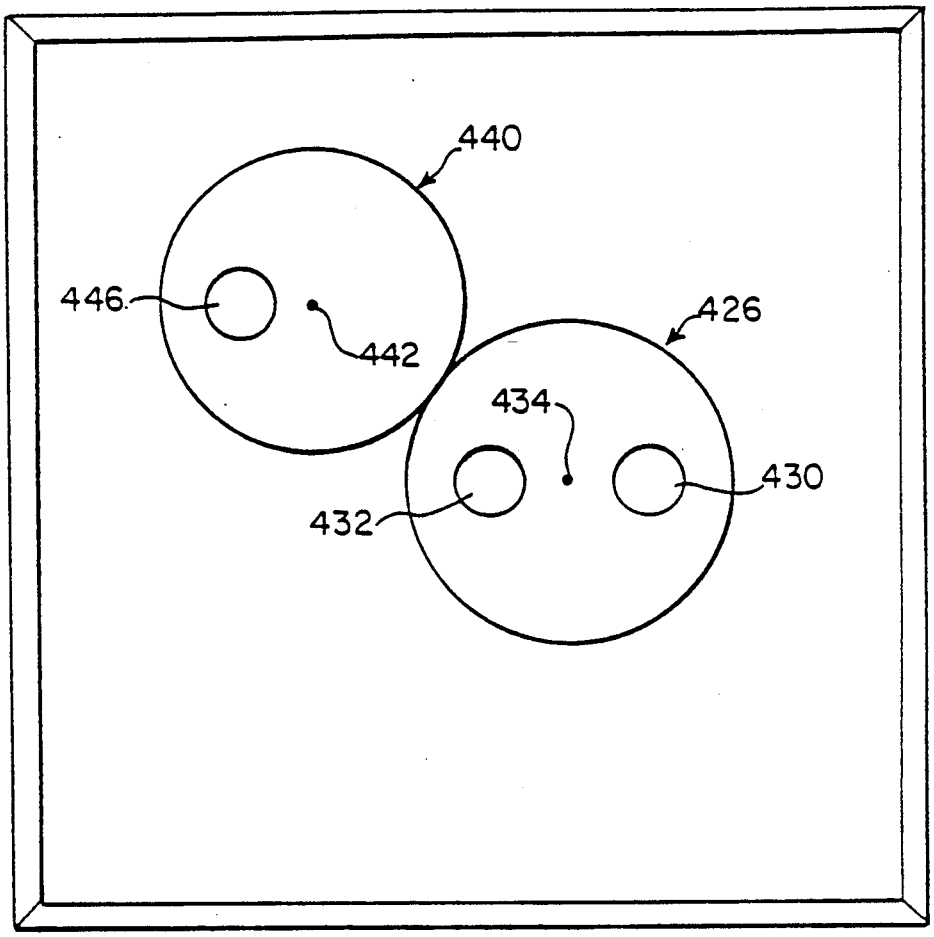
FIG. 16 is a schematic cross-sectional illustration of a trammel gear and output gear of the embodiment of FIG. 15.
Figure 17:
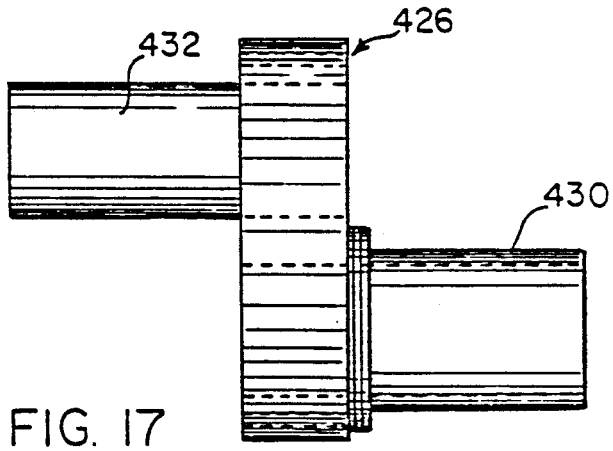
FIG. 17 is an elevational view a portion of the embodiment of FIG. 15.
Figure 18:
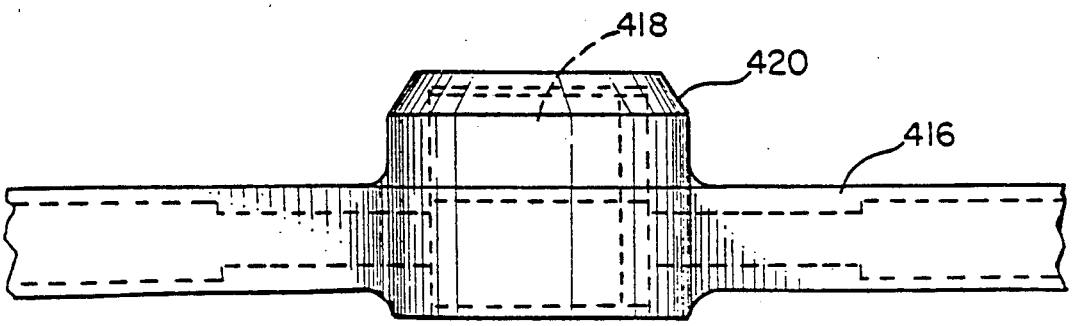
FIG. 18 is a fragmentary elevational view of a portion of the yoke of the embodiment of FIG. 15.

Referring to FIGS. 15 through 18 a preferred type of trammel gear of the invention will be considered. As is shown in FIG. 15, a block 400 which may be of the type shown in FIG. 1 will have suitable cylinders and pistons (not shown). First connecting rod 406 has a yoke 410 which has opening 408. Second connecting rod 416 is oriented generally perpendicular to first connecting rod 406 and has yoke 420 which defines opening 418. Coordinated oscillation of the connecting rods 410, 420 will produce oscillation of openings 408, 418. (A detail of yoke 420 which may be identical with yoke 410 is shown in FIG. 18.

As is shown in FIGS. 16 and 17 trammel gear 426 has a center 434 and a pair of projecting shafts 430, 432 which are secured thereto and project in opposite directions. In the form shown shafts 430, 432 have their centers spaced from center 434. Each shaft 430, 432 is rotatably received within a yoke opening 408, 418 preferably with a suitable interposed bearing (not shown). It will be appreciated that by providing yokes 410, 420 in the appropriate relative positions, oscillation of connecting rods 406, 416 will through yokes 410, 420 and shafts 430, 432 effect responsive rotation of trammel gear 426. Output gear 440, has a center 442 and is secured to output shaft 446. It has teeth (not shown) intermeshed with teeth (not shown) of trammel gear 426. Rotation of output gear 440 will effect axial rotation of output shaft 446.

It will be appreciated, therefore, that the present invention provides a compact, high efficiency, durable, easy to maintain oscillatory motion apparatus. When employed in an engine, it has a high horsepower to weight ratio. The apparatus converts linear oscillatory motion which may be considered to be within a plane to rotational motion.

While the oscillatory motion apparatus of the present invention may be employed for numerous purposes and when employed in the engine environment may take many forms, an example of certain parameters in the engine environment may be helpful with reference to FIG. 1, the engine block or crankcase 2 may have a depth of about 6 to 7 inches and length and width of about 6 to 12 inches. The length and width are preferably equal. The overall size of the engine block 2 and cylinder projections may be about 6 to 7 inches deep and about 18 to 26 inches in length and width. The engine and support equipment may weigh about 80 to 150 pounds. The horsepower to weight ratio may be about 1 to 4 without augmented combustion processes.

While, for convenience of reference, the disclosure has focused upon use of the apparatus to convert oscillatory motion to rotary motion, it may be employed in a reverse manner to convert rotary input into oscillatory output such as might be employed in a pump, for example.

While for simplicity of disclosure specific reference has been made herein to embodiments of the invention employed in engines, the invention is usable in many additional devices such as pumps on apparatus wherein such motion may be advantageously employed.

While, for convenience of reference, the use of pins in effecting certain connections between members has been described, it will be appreciated that other means of effecting secure mechanical joinder while permitting the desired freedom of movement will be apparent to those skilled in the art and may be used. A bearing yoke, for example, may be employed.

While the rigid connecting rods shown herein are generally straight, it will be appreciated that if desired in order to save space or for other reasons, they may be created with a generally U-shaped offset within which the trammel gear may be received. The offset would be so sized as to permit the desired oscillatory movement.

While the trammel gear disclosed herein has been illustrated as being circular, it will be appreciated that it may be elliptical, egg-shaped, nautilus shaped or provided in any other functionally effective form such as a translating crank, for example.

While the apparatus of the present invention has been shown as having two sets of connecting rods connected to the trammel gear if desired, additional connecting rods angularly offset from the others may be secured to the trammel gear.

Whereas particular embodiments of the invention have been described above for purposes of illustration, it will be appreciated by those skilled in the art that numerous variations of the details may be made without departing from the invention as described in the appended claims.

We claim:

1. An internal combustion engine comprising first substantially rigid connecting rod means mounted for oscillating movement in a first direction, second substantially rigid connecting rod means mounted for oscillating movement in a second direction, first trammel gear means pivotally secured to said first substantially rigid connecting rod means, said first trammel gear means pivotally secured to said second rod means, whereby coordinated oscillating movement of said first substantially rigid rod means and said second substantially rigid connecting rod means will effect responsive rotational movement of said trammel gear means, output gear means operatively associated with said trammel gear means for effecting rotational movement thereof responsive to rotation and translation of said trammel gear means, an engine block for an internal combustion engine, first and third cylinders generally aligned on a first axis, second and fourth cylinders generally aligned on a second axis, said second axis being oriented substantially perpendicular with respect to said first axis, first and third pistons disposed respectively within said first and third cylinders and adapted for reciprocating movement therein, said first substantially rigid connecting rod means fixedly secured to said first and third pistons, second and fourth pistons disposed respectively within said second and fourth cylinders, said second substantially rigid connecting rod means oriented generally perpendicularly with respect to said first connecting rod means, said second connecting rod means being fixedly secured to said second and fourth pistons, first pivot means connecting said first trammel gear means with said first connecting rod means, second pivot means connecting said first trammel gear means with said second connecting rod means, said first and second pivot means including pivot pins, said second connecting rod means having a first connecting rod and a second connecting rod, said first connecting rod being connected to said first trammel gear means, second trammel gear means connected to said second connecting rod and said first connecting rod means, and second output gear means operatively associated with said second trammel gear means.

2. The engine of claim 1 including endless belt means connecting said trammel gear means to said output gear means, said trammel gear means being a trammel gear having teeth and said output gear means being an output gear having teeth, and said trammel gear means being intermeshed with said output gear.

3. The internal combustion engine of claim 1 including said second output gear means having an output shaft, and flywheel means secured to said second output gear means output shaft.

4. The internal combustion engine of claim 1 including said first connecting rod means passing between said first connecting rod and said second connecting rod.

5. The internal combustion engine of claim 4 including each said trammel gear means being unitary and having a generally disk-like shape.

6. Oscillatory motion apparatus comprising first rod means mounted for oscillating movement in a first direction, second rod means mounted for oscillating movement in a second direction, first trammel gear means pivotally secured to said first rod means by first pivot means, said first trammel gear means pivotally secured to said second rod means by second pivot means, whereby coordinated oscillating movement of said first rod means and said second rod means will effect responsive rotational and translational movement of said trammel gear means, said first pivot means being relatively spaced from said second pivot means, output gear means operatively associated with said trammel gear means for effecting rotational movement responsive to the rotational component of said trammel gear means movement, said apparatus being an engine, said first trammel gear means having a trammel gear, and a ring gear having an opening within which said trammel gear is received and is in intimate contact therewith, whereby rotation of said trammel gear will effect responsive rotation of said ring gear which in turn will effect rotation of said output gear means.

7. The engine of claim 6 including output gear means disposed adjacent said ring gear, and said output gear means having external teeth.

8. The engine of claim 7 including said ring gear having external teeth meshing with said output gear means' teeth.

9. The engine of claim 8 including output shaft means fixedly secured to said output gear for rotation therewith, whereby rotation of said ring gear will effect responsive rotation of said output shaft.

10. The engine of claim 9 including said ring gear opening having bearing means, and p1 said trammel gear rotatably mounted within said opening in said ring gear.

11. The engine of claim 10 including the center of said trammel gear being displaced from the point of intersection of said first rod means and said second rod means.

12. The engine of claim 9 including said output gear means having four said output gears.

13. The engine of claim 12 including said output shaft means having a centrally mounted output shaft on each said output gear, whereby rotation and translation of said output gears will effect axial rotation of said output shafts.

14. Oscillatory motion apparatus comprising first rod means mounted for oscillating movement in a first direction, second rod means mounted for oscillating movement in a second direction, first trammel gear means pivotally secured to said first rod means, said first trammel gear means pivotally secured to said second rod means, whereby coordinated oscillating movement of said first rod means and said second rod means will effect translational and rotational movement of said trammel gear means, said first rod means having a first yoke, said second rod means having a second yoke, and said trammel gear means pivotally secured to said rod means through said yoke means, eccentrically mounted output means operatively associated with said trammel gear means, whereby the rotational component of the movement of said trammel gear means will effect responsive rotational movement of said output means.

15. The oscillatory motion apparatus of claim 14 comprising said apparatus being an engine.

16. The engine of claim 15 including a pair of shafts projecting from opposed sides of said trammel gear means, each said shaft rotatably received within a said yoke, whereby oscillation of said first rod means and said second rod means will effect responsive rotation of said trammel gear.

17. The engine of claim 16 including bearing means interposed between said yokes and said shafts.

18. The engine of claim 16 including said output means having output gear means having an output shaft, and said output gear means being operatively associated with said trammel gear means, whereby rotation of said output shaft will be effected responsive to rotation of said trammel gear means.

* * * * *